United States Patent [19]

Hampel

[11] Patent Number: 4,625,468

[45] Date of Patent: Dec. 2, 1986

[54] TEMPORARY/PORTABLE NUCLEAR FALLOUT SHELTER

[76] Inventor: Viktor E. Hampel, 2783 Curlew Ct., Pleasanton, Calif. 94566

[21] Appl. No.: 510,583

[22] Filed: Jul. 5, 1983

[51] Int. Cl.[4] ..... E04H 9/10; E04G 11/04; A45F 1/16

[52] U.S. Cl. ..... 52/2; 52/169.6; 109/1.5; 135/94; 135/115

[58] Field of Search ..... 109/1.5; 52/169.6, 2; 135/94, 96, 115

[56] References Cited

U.S. PATENT DOCUMENTS

| | | | |
|---|---|---|---|
| 3,161,990 | 12/1964 | Morris, Jr. | 52/169.6 X |
| 3,598,133 | 8/1971 | Abert | 135/94 |
| 3,660,951 | 5/1972 | Cadwell | 109/1.5 X |
| 4,265,259 | 5/1981 | Gillis | 135/115 X |

FOREIGN PATENT DOCUMENTS

| | | | |
|---|---|---|---|
| 755885 | 4/1967 | Canada | 52/2 K |
| 1140997 | 3/1957 | France | 52/169.6 |
| 6025 | 1/1982 | Japan | 52/169.6 |
| 2008646 | 6/1979 | United Kingdom | 52/2 |
| 2084211 | 4/1982 | United Kingdom | 52/169.6 |

*Primary Examiner*—Alfred C. Perham

*Attorney, Agent, or Firm*—Hamrick, Hoffman, Guillot & Kazubowski

[57] ABSTRACT

Significant, life-saving protection from airborne, radioactive (fallout) particles due to nuclear explosions, nuclear reactor accidents, and other releases of radioactive particulate is provided by a double-wall tent structure quickly erectable over a central bench or hole. The tent structure includes tightly woven, rip-resistant fabric panels supported by tensile rods or wands, a tub floor extending into and lining a central trench or hole, and an exterior, light-reflecting, metalized, semi-transparent disposable membrane. The bottom circumferential edge of the outer membrane extends into a shallow trench or ditch, excavated around the perimeter of the inner tent structure. Dust particles settling onto the smooth exterior surface of the membrane slide off and are captured in the shallow ditch, thus minimizing direct or indirect radiation into the central trench or hole and its occupants. The perimeter of the outer membrane contains pockets for the storage of potable water and for anchoring of the outer membrane. The tub floor lining extending below the ground surface includes sealable pockets suitable for the storage of refuse and human waste during occupancy. Also described is a light-weight single membrane, plastic, portable tent, suitable for low-cost mass production.

16 Claims, 18 Drawing Figures

FIGURE 10
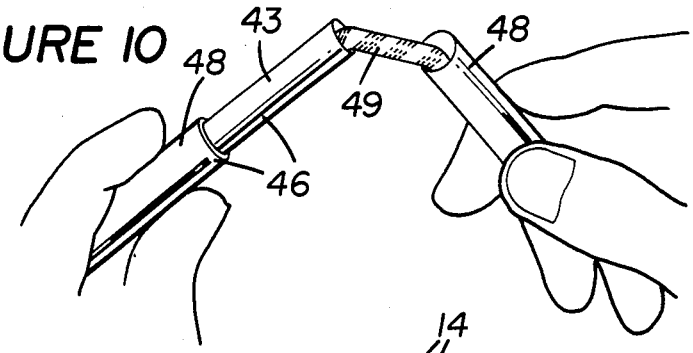
FIGURE 9
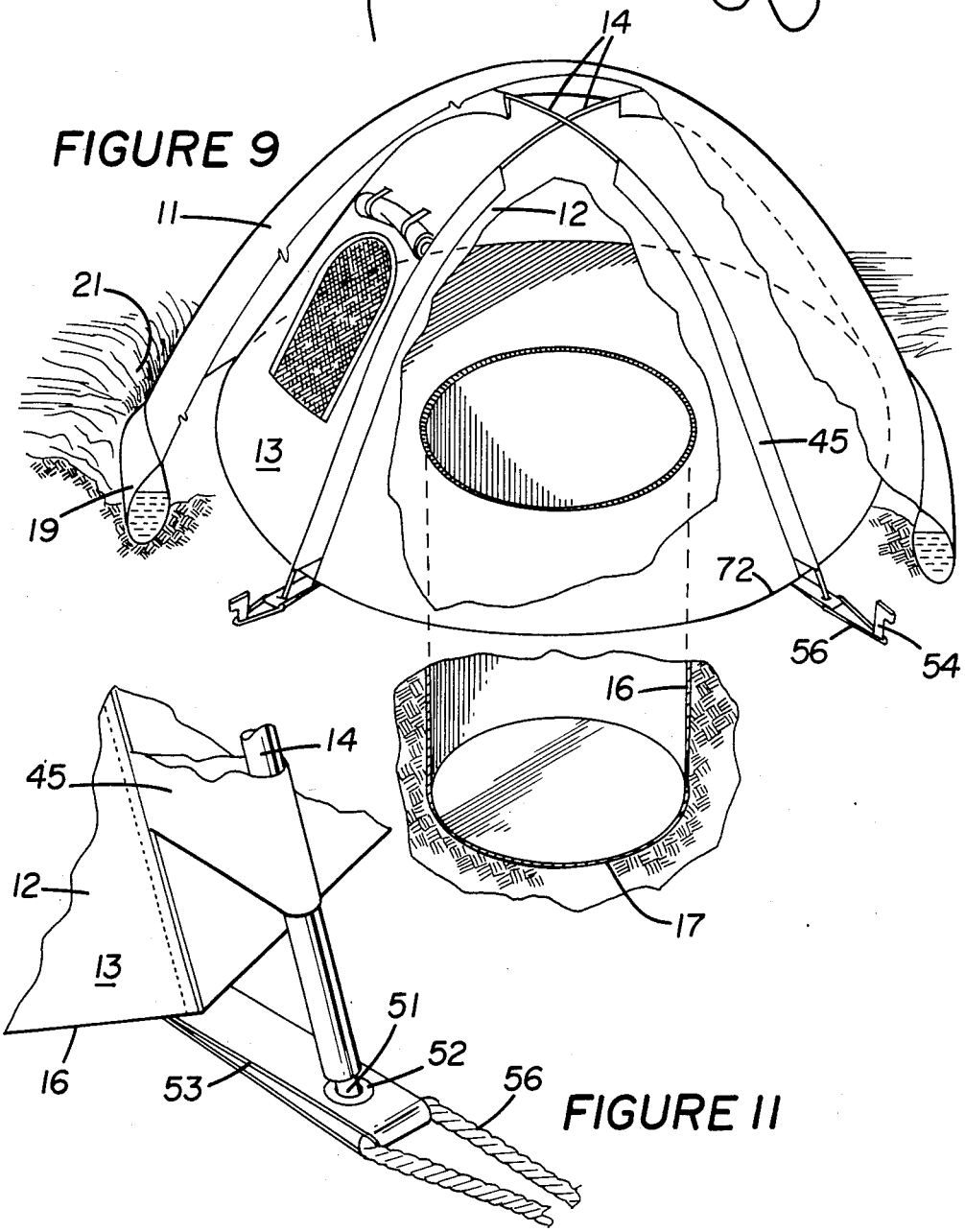
FIGURE 11

FIGURE 12
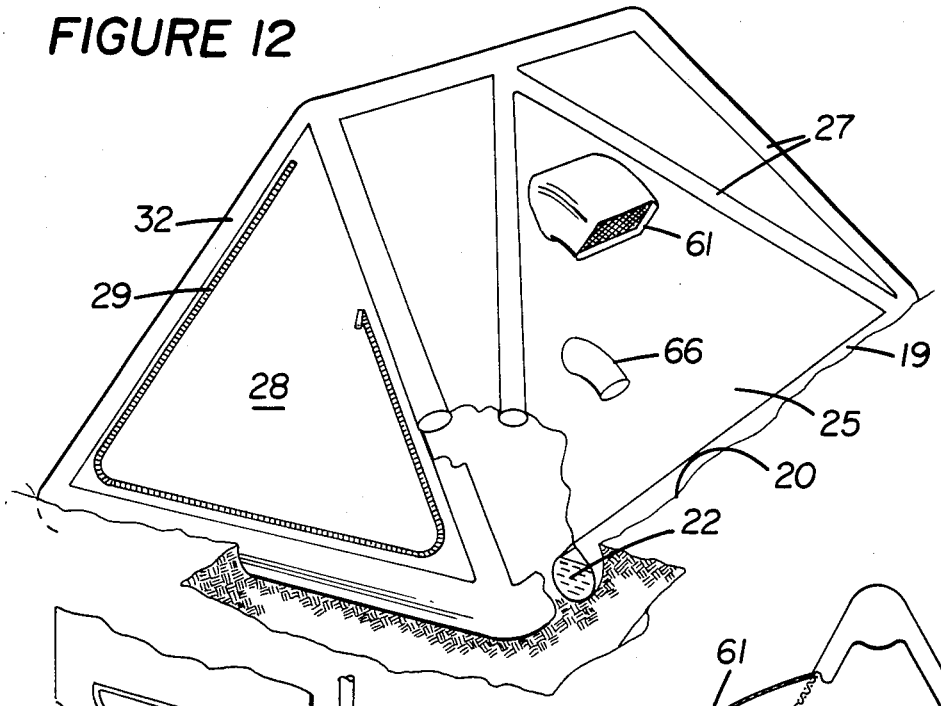
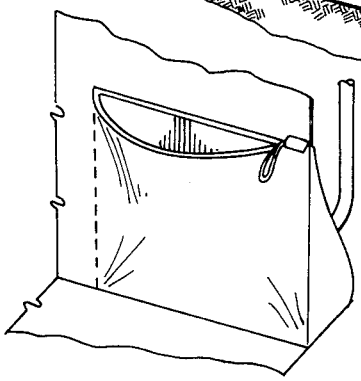
FIGURE 15
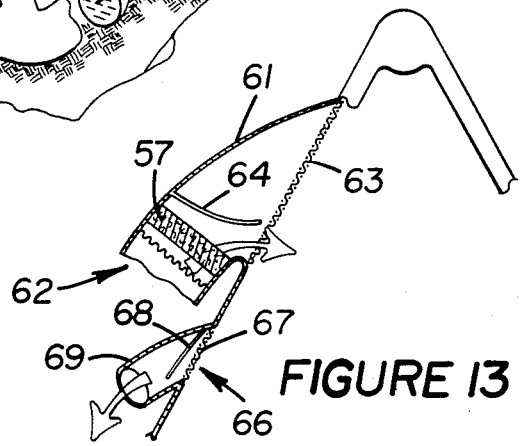
FIGURE 13
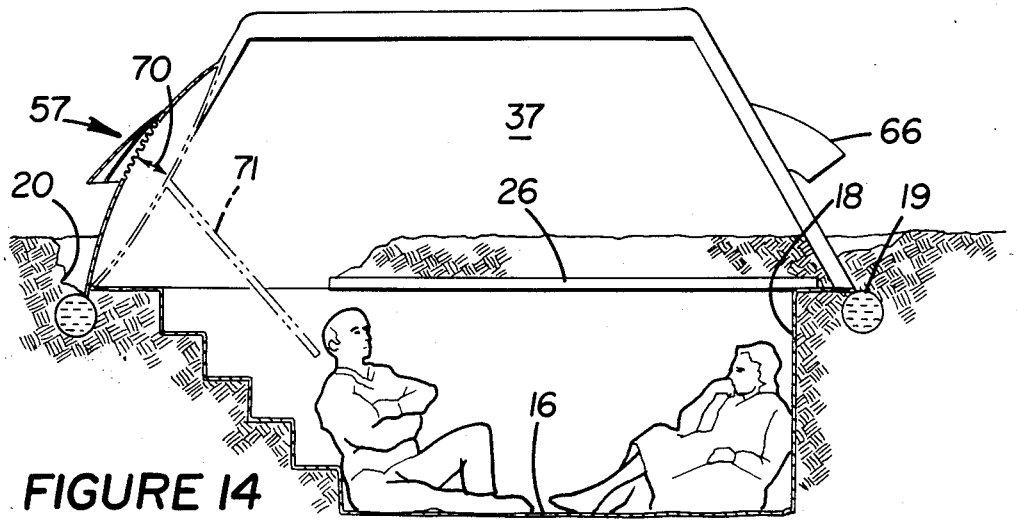
FIGURE 14

TEMPORARY/PORTABLE NUCLEAR FALLOUT SHELTER

BACKGROUND OF THE INVENTION

Shelters for protecting individuals from residual nuclear radiation emanating from radioactive airborne particles (fallout) are typically designed for the purpose of attenuating high-energy gamma radiation. In particular, conventional fallout shelters are usually designed as permanent underground structures to provide shielding and are constructed of high density materials to attenuate radiation emanating from radioactive fallout on the ground and on top of the shelter. Such structures are immovable, expensive to construct, and difficult to maintain.

Permanent fallout shelters also have distinct disadvantages in that they can become traps for their occupants in the event of blast or fire of the structure above them. Occupants can also be trapped by their shelters in areas of high-intensity fallout simply because they do not have suitable shelters available to them elsewhere. Finally, after a period of time, permanent shelters can become contaminated by radioactive contaminants, carried by inadvertent human traffic in and out of the shelter, and thus become unusable.

Also, most of the world's population does not live in anticipated prime target areas in the event of nuclear war, but does live in areas conceivably affected by radioactive fallout from nuclear explosions in the target areas.

Moreover, large numbers of people live in areas that can be significantly affected by radioactive contamination from accidents involving nuclear reactors. Construction and maintenance of permanent fallout shelters composed of high-density materials, protecting populations in areas downwind from a nuclear reactor, has not been considered practical. The effectiveness of large-scale evacuations of populations downwind of nuclear accidents is also in doubt due to panic, loss of effective communications, and abandonment of traffic controls.

Further, case studies of World War II disasters show that in general, civilian populations tend to return to the homes once abandoned, expecting to find shelter and life substance. In summary, a need exists for a portable lightweight, low-cost shelter to provide protection from radioactive airborne dust particles.

It is generally known that a simple hole in the ground can provide significant protection fom gamma radiations emanating from surface contaminants. In particular, an individual who positions himself in the hole is effectively shielded by the surrounding earth from radiations from surface particles. Furthermore, the effective protection provided by a hole in the ground is significantly enhanced if the contaminants can be prevented from settling into the hole, above the hole, or adjacent to the walls of the hole. See *Crash Civil Defense Program Planning, Volume I, Appendix F,* Page 1–7 (1964), Research Triangle Institute.

It is also generally known that the intensity of radioactivity from nuclear weapon fallout decreases relatively quickly. The intensity falls by a factor of 10 after 7 hours, a factor of 100 after 49 hours, and a factor of 1000 after two weeks. A dose above 50 rem over a short period of time (6 to 7 days) in 90% of the cases is fatal to the person exposed, with death occurring within a few weeks. Death may result from the effects of radiation or from opportunistic, commonly known infectious agents. (A rem or "roetgen-equivalent-man" is a measure of biological damage.)

Populations living largely downwind of targets and outside the central zone directly affected by blast and thermal radiation are expected to receive from 900–3000 rem. Such populations will die or be severely injured unless they can be protected from the effects of short-lived radioactive debris and fallout. Since the estimated maximum toleratable does is 25 rem (cumulative) large fractions of such populations can be saved by trenches and/or holes which provide a protection factor of 100 or better, provided that the accumulation of radioactive fallout inside the trench can be prevented. "It is of interest to mention that a simple one-man foxhole, 3 feet in diameter and 4 feet deep, can provide a protection factor of about 40 if fallout is present up to the edge, but not inside. If an area of 3–4 feet wide around the foxhole is kept free of fallout material, a protection factor of 100 or more is possible." *The Effects of Nuclear Weapons,* Samuel Glasstone, Revised Edition, 1964, page 473, section 0.140.

Radioactive fallout from a nuclear reactor is generally known to be long-lived. Here, the immediate protection of the population from intensive radiation, inhalation, and ingestion of radioactive particular matter is of paramount importance until rescue missions can be executed. Under peacetime conditions, rescue can be expected to take place shortly after an accident. Even in instances where a nuclear weapon explosion causes a nuclear reactor accident (the worse case possible), if the affected population has 30 to 60 minutes' warning and can take shelter in some sort of portable/temporary fallout shelter, the magnitude of injury can be significantly reduced.

Other references which discuss problems of shetler for populations in the event of significant radioactive particulate fallout include:

*National Fallout Shelter Program,* Sixteenth Report by the Committtee on Government Operations, May 32, 1962, 87th Congress, 2nd Session, House Report No. 1754.

*Maintenance of Civil Defense Shelters in the U.S.S.R.,* by Yu Yu Nammerer et al., July 1967.

Refer to Publications of the Department of the Navy, Bureau of Yards and Docks.

*Fallout Protection for Homes with Basements,* Revised, May 1967. C. D. Publication, Item 857-D-1.

*Strategy for Survival,* Martin and Latham, Page 282, 1963.

*Foxhole Shielding of Gamma Radiation,* Project 2.3–2, JANGLE, Nevada Proving Grounds, October-November 1951, Armed Forces Special Weapons Project, Washington D.C., WT-393.

*The Effects of Nuclear War,* Office of Technology Assessment, Congress of the United States, Library of Congress Catalog Card Number 79-600080, 1979.

*Last Aid, The Medical Dimensions of Nuclear War,* E. Chivian M.D., Susanna Chivian, R. J. Lifton, M.D., J. E. Marck, M.D., page 38–39, 1982.

SUMMARY OF THE INVENTION

Tent structures are described which include disposable, exterior, semi-transparent plastic and/or fabric shield membranes covering a tent composed of stretched, tightly woven, rip-resistant fabric panels supported by tensile rods/ wands. The tent includes a tub floor extending down into and accommodating a central trench or hole. The bottom exterior edge of the shield membrane extends into and is partially buried in a shallow ditch excavated around the perimeter of the tent structure.

Contaminated and/or radioactive particles settling on the exterior surface on the shield shaken or sliding off the membrane are captured in the shallow trench precluding contamination of the central trench or hole, and minimizing radiation scattering into the central trench or hole. All above-surface components of the tent structure are composed of materials which are essentially transparent to high-energy gamma radiation, further minimizing secondary radiation scattering into the central trench or hole. The interior fabric panels and tub floor of the tent structure are coated with a plastic material such as urethane to render the interior essentially air- and watertight.

A simple dust filtration system is incorporated into a panel of the outer shield membrane for removing dust contaminants, allowing air circulation into and through the interior of the tent. Air circulation is induced by movement of the tent walls caused by wind and/or the occupants.

In particular embodiments, the bottom circumferential edge of the shield membrane is formed into a tubular enclosure for receiving and storing water, for holding the shield membrane initially in place inside the circumferential trench. Sealable and vented pockets for refuse and human waste are also incorporated into the walls of the tub lining the hole or trench.

The invented tent structure has the advantage of being easily erected over a hole or trench to provide significant protection from airborne radioactive contaminants to occupants who wait until either initial high-intensity radiation danger subsides or rescue occurs.

Other advantages of the invented shelter include low cost mass production. The shelter can also be easily decomaninated, dismantled, and moved to a different location. The shield membrane and the tub floor are replaceable. Finally, the inner tent, equipped with a conventional tub floor, can be used as a conventional tent for outdoor recreation.

DESCRIPTION OF THE FIGURES

FIG. 9 is a perspective cut-away view showing the elements of the invented tent fallout shelter for a tent having a circular configuration.

FIG. 10 is a detail showing a shock cord within the tensile rods/wands, for resiliently supporting the tent.

FIG. 11 is a detail showing the manner of securing the tensile rods and wands at the ground surface.

FIG. 12 is a perspective view of an alternative embodiment of a portable tentlike structure supported by air-filled ribs inflatable by occupants from the inside.

FIG. 13 is a detail showing a simple butterfly valve system for assuring filtered air circulation into the interior of a tent structure.

FIG. 14 illustrates a mechanism for circulating air through the interior of the tent structure.

FIG. 15 illustrates pockets incorporated into the walls of the tub lining, with vents for receiving refuse and human waste.

DESCRIPTION OF THE PREFERRED EMBODIMENTS

Figure 1:
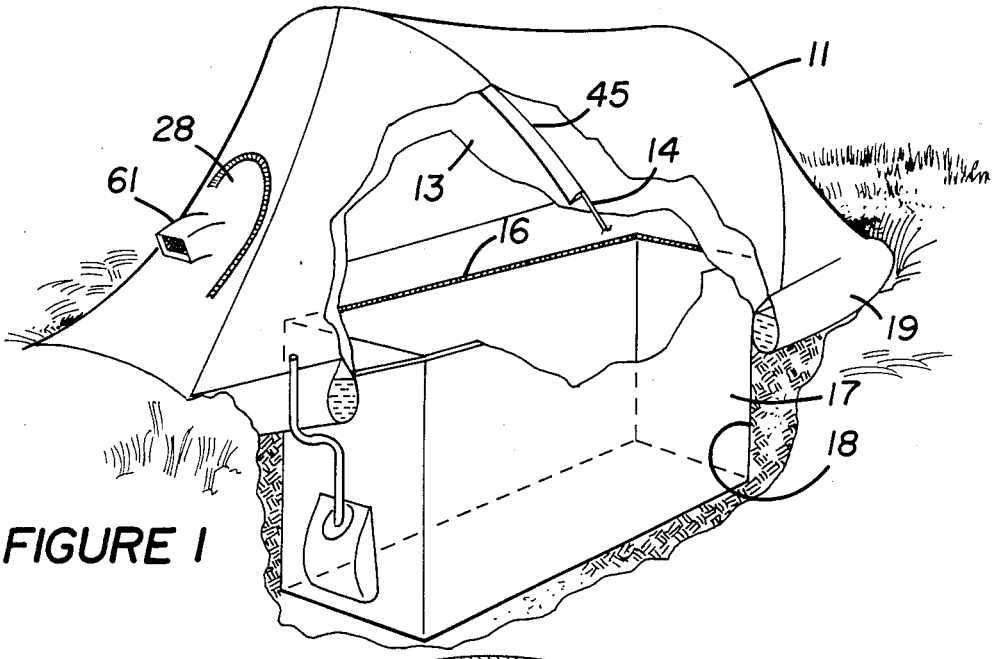
FIG. 1 is a perspective cutaway view of the invented fallout shelter showing the interior tent structure, the shield membrane, and the tub floor extending into a central trench.

Referring now to FIGS. 1, 2, 3, and 9, the essential components of the invented temporary/portable nuclear fallout shelter include a disposable shield membrane 11, stretched and anchored over a tent 12. The tent is formed by stretched, tightly woven, rip-resistant fabric panels 13 supported by precurved tensile rods and/or wands 14. The tub or floor 16 of the tent 12 has a central hexahedral or cylindrical-tubular section 17 extending downward, adapted to be received in and to line a trench or foxhole 19 over which the tent 12 is erected.

The bottom circumferential edge 19 of the shield membrane 11 extends into and is partially buried in a shallow ditch 20 excavated around the perimeter of the tent 12.

The circumferential edge 19 of the shield membrane may be formed into a tube 21 for receiving and storing water 22. The water-filled tube also serves to anchor the circumferential edges of the shield membrance 11 during the initial period of occupancy. As the water is gradually used, placement of the earth, rock, and the like from the inside structure can be placed against the tube 22 for anchoring the edge of the membrane 11.

Figure 4:
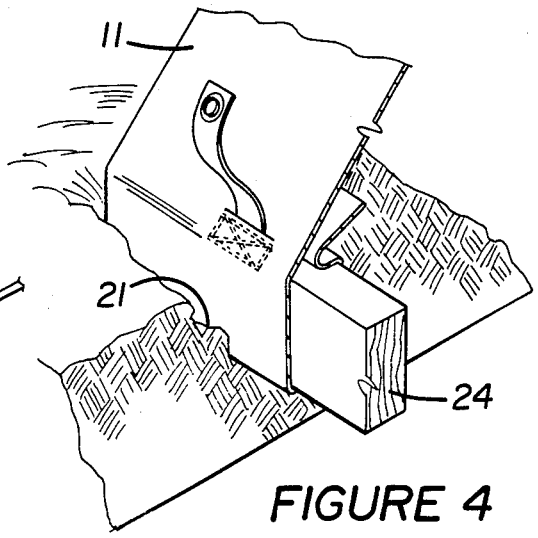
FIG. 4 is a detail showing the manner of securing the circumferential edge of the shield membrane in a shallow ditch or trench.

Alternatively, as shown in FIG. 4, the shield membrane 11 can be anchored by (1) attaching to or wrapping its circumferential edge 19 to or around a board 23 or similar weight; (2) placing it into a shallow ditch 21 excavated around the perimeter of the tent 12; and (3) partially burying it.

The shield membrane 11 is a thin sheet of plastic material or plastic-impregnated fabric that is waterproof and resistant to tearing (ripping). To prevent or minimize overheating within the structure because of absorption of solar radiations, the shield membrane 11 should be reflective. It should also be semi-transparent to allow the shelter occupants to view their surroundings. The exterior surface of the shield membrane 11 should also be sufficiently smooth to prevent small dust particles from becoming lodged in or on it, so that dust particles that settle onto the membrane shield can be shaken off or dislodged by simply shaking the membrane 11.

A suggested shield membrane material meeting the above criteria is aluminized mylar sheets. Also, other metalized plastic sheet materials would be suitable.

The fabric panels 13 forming the inner tent structure 12, the tub floor 16 and tubular extension 17 are treated or impregnated with a plastic material to prevent penetration of small dust particles. In fact, it is desirable to coat the interior surfaces of the fabric panels 13 and seams between adjacent panels with a plastic or other similar substance to render the volume enclosed within the tent structure substantially air-tight. Air is then circulated into and out of the volume enclosed by the tent structure 12 through air filtration ports, described in greater detail, infra.

Figure 2:
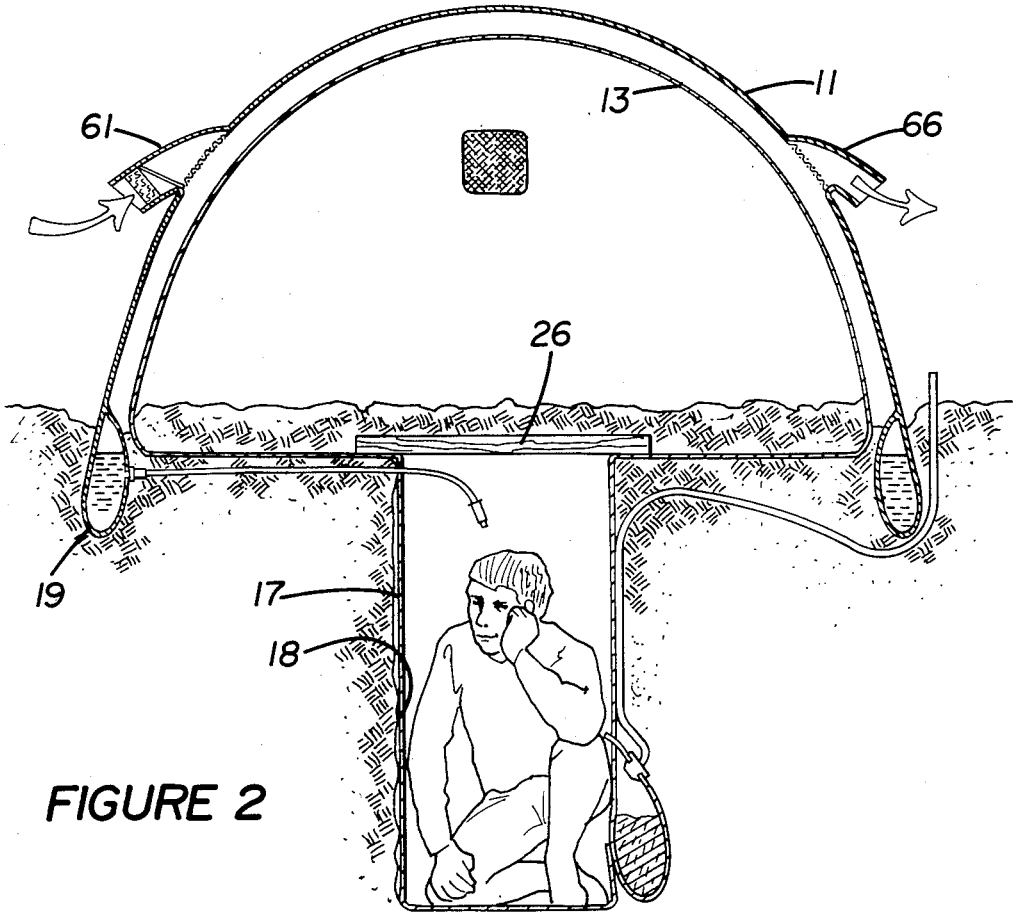
FIG. 2 is a cross-sectional view of the invented portable fallout shelter showing a cross-section of the tent structure, tub floor, central trench, air circulation between the shield membrane and tent panels, and vented waste disposal pockets.
Figure 3:
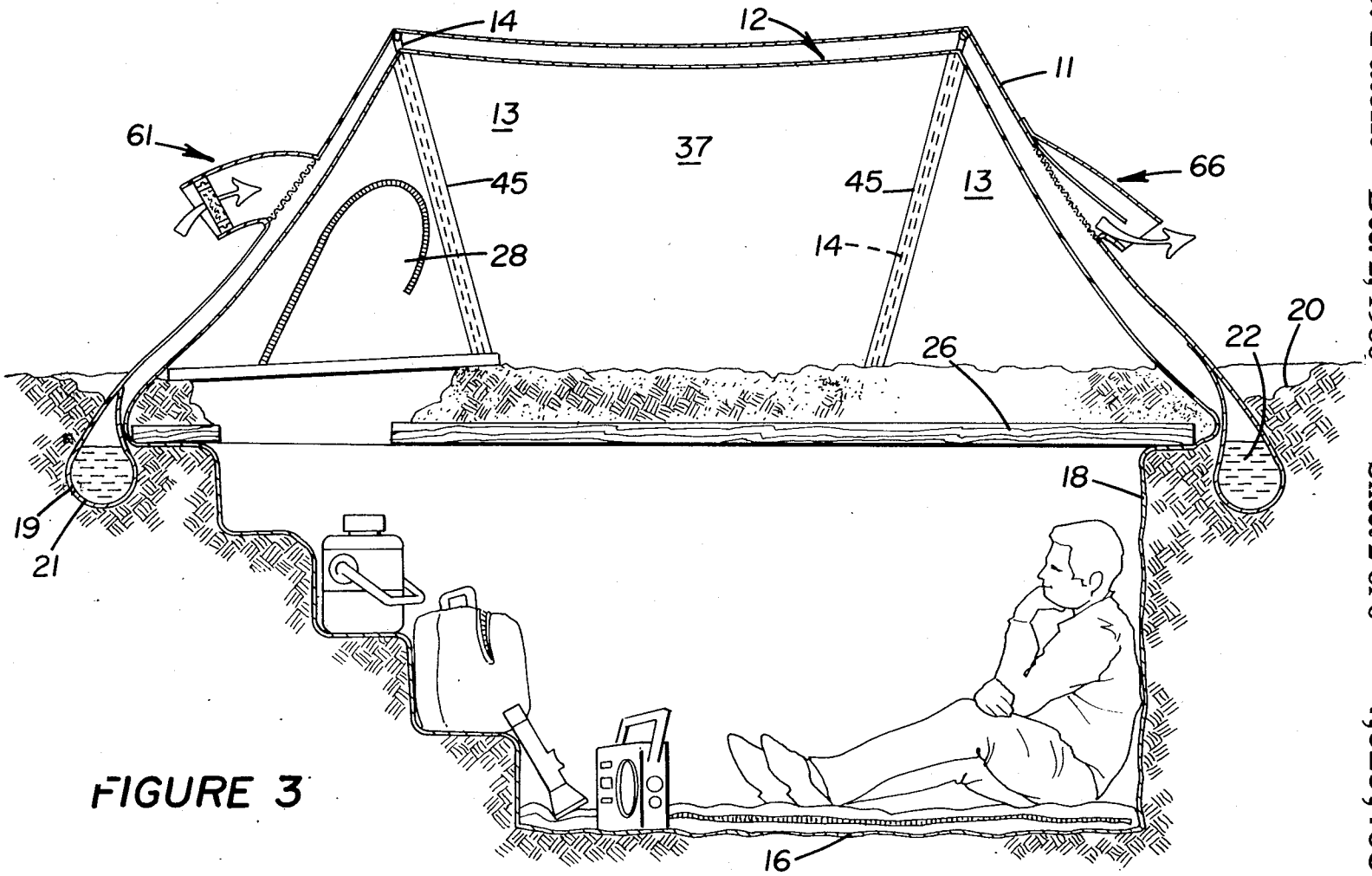
FIG. 3 is a longitudinal cross-sectional view of the invented portable shelter.
Figure 5:
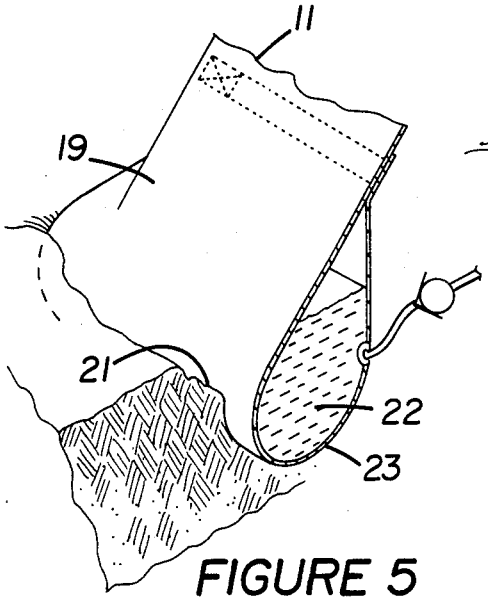
FIG. 5 is a detail showing the circumferential edge formed into a tubular configuration for receiving and storing water.

Referring to FIGS. 2, 3, and 14, a platform 26 formed from a door, board, or other similar material can be placed over the trench or foxhole 18 within the tent 12. In such instances, dirt can then be thrown and piled on top of the platform 26 to attenuate "skyshine" radiations emanating from airborne radioactive particles in the atmosphere and stratosphere above the shelter. The top surface of this dirt on the platform should be below the horizontal ground level to prevent it from becoming a secondary scattering source of radiations from radioactive dust accumulations (fallout) on the ground surface.

Referring now to FIGS. 12 and 14, another embodiment of the invented temporary/portable fallout shelter is shown which comprises a single layer of material 25 composed of, for example, aluminized mylar or other non-porous, lightweight, but thin strong sheet material supported in a tentlike configuration by air-filled ribs 27. The structure is anchored by a water-filled tube 22 forming its circumferential edge 19 which is received and partially buried in a shallow ditch. The structure is erected over a central ditch or foxhole 18. Alternatively, the tub floor 16 can be appropriately dimensioned to have sufficient slack to extend into and line a central trench or foxhole 18 when the structure is erected.

Ingress and egress from the described shelters are via entrance port(s) 28 covered by a door or flaps 31 which include menas 29 for establishing a hermetic (airtight and watertight) seal with the shoulder 32 of the entrance ports 28. In particular, referring to FIGS. 6 and 8, the edge of a door flap 31 for entrance port 28 through a (1) shield membrane 11, (2) fabric panel 13, or (3) tent wall 25 may be formed into or secured to a beaded shoulder 33 which is adapted to be snugly or compressively received in a correspondingly shaped channel 34 forming the shoulder 32 of the entrance ports 28.

Figure 6:
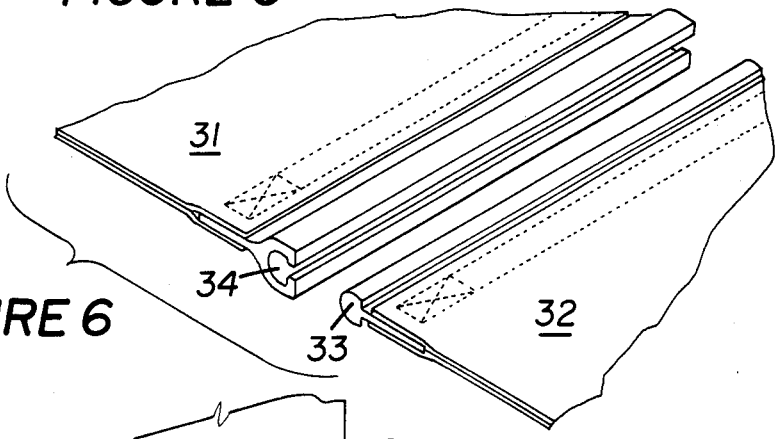
FIG. 6 is a detail showing a fastening mechanism for interconnecting elements of the plastic shield membrane.
Figure 8:
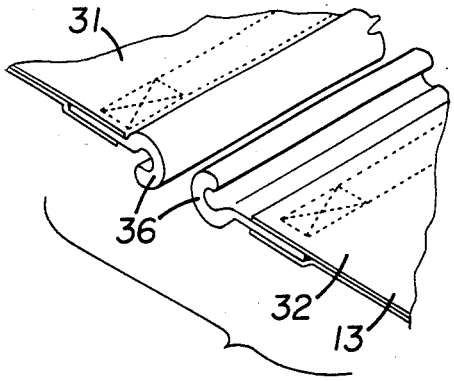
FIG. 8 is a detail showing mechanism for interconnecting elements of the fabric tent together.

FIG. 8 illustrates another embodiment of a fastening mechanism wherein the edge of the door flap 31 and the shoulder 32 of the entrance port 28 are formed into and/or secured to hook channels 36. The hook channels are rotated 180 degrees with respect to each other such that the tip section of each channel 36 is snugly and compressively received between the tip and shank othe other hook channel. Similar fastening mechanisms, as illustrated in FIGS. 6 and 8, may be utilized to cover and seal other access ports through (1) the shield membrane 11, (2) a fabric panel 13, (3) the tent wall 25, and/or 4) tub floor 16. The essential criteria in choosing the fastening mechanisms is that the mechanism when fastened mussut minimize or preclude dust infiltration into the interior 37 of the tent shelter.

Figure 16A:
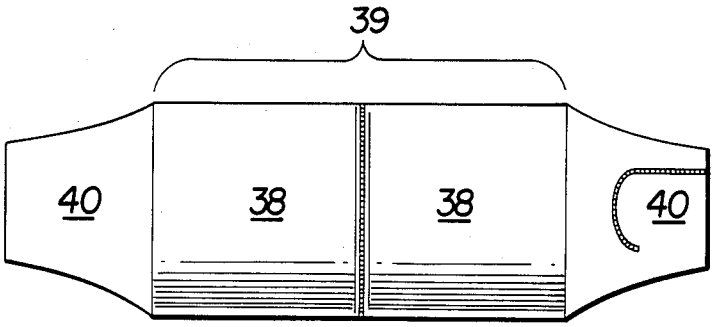
FIGS. 16(*a*), (*b*) and(*c*) are top views of shield membranes secured together in different configurations, illustrating temporary modular shelter structures.
Figure 16B:
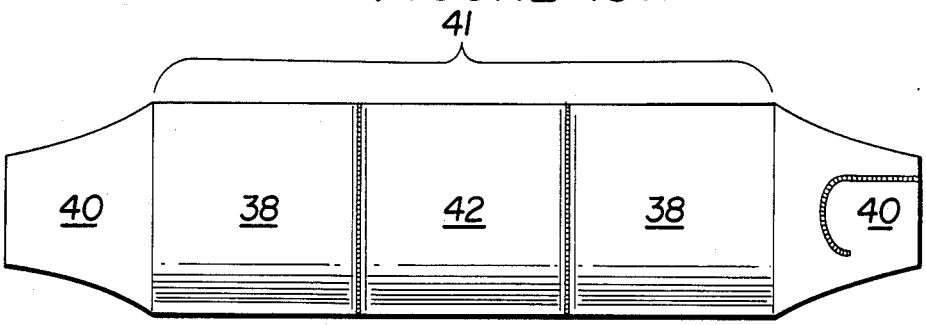
Figure 16C:
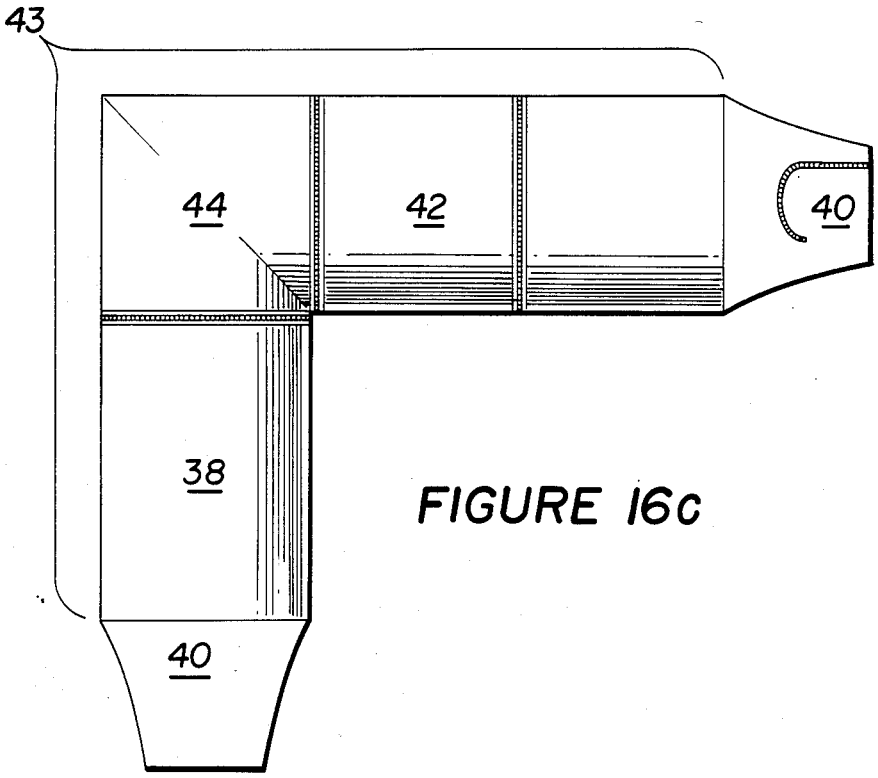

Sealing and fastening mechanisms may also be utilized for securing together several shield membranes 11 and/or fabric panels 13 to form modular structures. As shown in FIGS. 16(*a*), (*b*) and (*c*), dust-tight fastening mechanisms interconnect modular tent structures 38 and their associated shield membranes 11. In FIG. 16(*a*), a structure 39 is formed by two modular tent units 38, each with a tapered (conelike) end 40. FIG. 16(*b*) shows a structure 41 formed of two modular tent units 38, two end units with tapered ends 40, and a central unit 42 without a tapered end 40. FIG. 16(*c*) shows still another structure 43 again formed of two end units tapered ends 40, a central unit 42, a modular tent unit 38, and a right-angle unit 44.

As illustrated in FIG. 1, each of the modular units forming the structures 39, 41, and 43 would include a central tubular hexahedral section 18 in the tub floor 16 which extends downward into a trench 18 over which the modular structure is erected. The hexahedral sections 17 in the tub floor of the modular tent unit include appropriately located access ports through side walls, including cover flaps for establishing a dust-tight seal over the port, air filters, waste receptacles, and transparent and/or semi-transparent windows.

Referring now to FIGS. 9 and 10, the tensile rods or wands 14 supporting the tent structure may be formed from hollow tubes of fiberglass, aluminum, or other lightweight, resilient, rigid material. The rods/wands 14 may also be precurved. The rods or wands 14 can be formed by a plurality of interconnecting short, hollow sections 46, each having a rodlike tip 43 being received in a hollow cylindrical base 48 of the next section. An elastic shock cord 49 is strung through the center of the hollow sections 42, making up the rod of wand 14 for holding the sections 46 in a proper sequential arrangement, yet allowing the wand to be taken apart and folded up and stored in a small space.

Referring to FIGS. 1, 9 and 11, the rods or wands 14 are received in tubular webs 45 integrally a part of, sewn, or otherwise secured to the fabric panels 13, forming the tent 12. The ends of the rods or wands 14 include a small diameter anchor tip 51 adapted to be received in a metal grommet ring 52 through a strap 53 formed into a loop with both ends of the strap 53 being sewn or secured to the perimeter of the tub or floor 17 of the tent 12. The anchor tips 51 at each end of the rod 14 are received in grommet rings 52 on diametrically opposite sides of the tent. The resulting elastic tension of the curved rod holds the tent erect and stretches the tub or floor 16 of the tent.

The combination of the curved tensile rods 14, held by the webbing tubes 45, stretched fabric panels 13 and stretched tub 16 provides a stable, sturdy, free-standing enclosure. Additional stability, particularly against heavy winds, can be provided to the tent 12 by tying the tent down to a plurality of ground stakes 54 secured to the loops formed by the straps 53 by an appropriate cord 56. Such stakes 52 should be located between the perimeter of the tub 16 and the ditch 21 receiving the circumferential edge 19 of the shield membrane 11.

Referring now to FIGS. 2, 13 and 15, air circulates into the interior spaces of the tent 12 through filters 57. The air filters may be incorporated into the shield membrane 11 and the fabric panel 13, forming the tent. New filters can be inserted from the inside in a manner that pushes out the contaminated filter to the outside, where it falls into the circumferential ditch.

Figure 7:
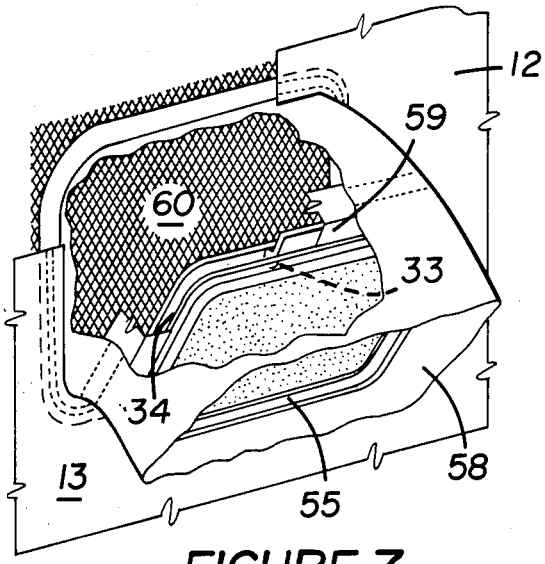
FIG. 7 is a detail showing disposable air filter mounted within a cylindrical cuff.

For example, referring to FIG. 7, a disposable air filter element 57 is fastened within a cuff 58 which in turn is sewn or secured to a mesh opening through one of the fabric panels 13, forming the wall of the tent 12. The perimeter of the filter element 57 and the corresponding free end of the cuff 58 are hermatically joined together to form a dust-tight seal. In the embodiment illustrated, the perimeter edge of the disposable filter element 58 includes a necked channel 34 of the type shown in FIG. 6, and the distal end of the cuff 58 includes a beaded shoulder 33 adapted to be received in the neck channel 34 of the filter element.

Referring now to FIG. 7, the disposable air filter 57 is received within the interior of a rectangular sleeve or cuff 58 formed of flexible but airtight material. The shoulder 59 of the cuff 58 is sewn or otherwise secured to the fabric panel 13, forming a wall of the tent 12. Mesh fabric 60 maintains the integrity of the fabric panel 13 while letting air flow into the cuff 58. A slightly elastic, flexible beaded edge 33 is sewn or attached around the distal end of the cuff. The disposable fliter element 57 includes a frame 55 formed of a relatively rigid material having an exterior annular groove 34 with the configuration adapted to snugly receive the beaded edge 33 of the cuff 58. Suitable air filtering materials are mounted and secured within the frame 55.

The air filter 57 should be protected from rain and other precipitation such that the contaminants filtered from the air are not subsequently leached from the air filter material by water under inclement weather conditions. For example, in the embodiments of the shelter shown in FIGS. 1, 2, 3 and 9, the air filter is protected through the inner tent from precipitation by the exterior shield membrane 11. In embodiments not having an exterior shield membrane 11, and for air filters through the membrane, a drip curtain or shield protects the filter and opening from precipitation.

Referring to FIGS. 12 and 13, an exterior cuff is formed of flexible material and secured to the exterior wall of the tent 12 such that the cuff opening 62 faces downward. A disposable air filter element 57 is positioned within the overhang 61 at a sufficient distance from the opening 62 to prevent the filter element from getting wet. The filter element 57 is again secured within the sleeve by suitable dust-tight fastening mechanisms of the type shown in FIGS. 6 and 8. There are holes 63 through the fabric or plastic panel 13 forming the wall of the tent 12 to allow air to circulate into the cuff opening 62 through the filter element 57 and into the interior of the tent 12. A flap of flexible material 64 is included on the interior side of the disposable filter element 57 within the overhang 61 to provide a simple butterfly valve to prevent air from flowing out of the tent through the filter. A second butterfly valve 66 is incorporated into the fabric or plastic panel forming the shield or wall of the opposite end of the tent which only allows air to flow from the interior of the tent to the exterior.

Care must be taken in locating the air filter openings/cuffs. Specifically, the filter elements, as contaminants are collected, will become a radiating source which can "shine" into the trench or hole if located on the upper or top surfaces of the tent shelter. Yet, if the filter were located close to the ground surface, it would be subject to clogging and contamination due to surface dust. Ideally, the air filter and associated openings are at positions on the tent strcutre which minimize shine into the trench or hole, sufficiently above the ground surface to prevent clogging and excessive contamination due to surface dust. (See FIG. 3.)

In some cases it may even be desirable for the occupants to be able to change the filter. Accordingly, the filter opening through the shield membrane should be located adjacent to or accessible from access ports through the interior tent walls.

Referring now to FIG. 15, the waste/refuse pockets incorporated into the walls of the tub lining include vent tubes which extend upwardly to a point proximate the ground surface. The pockets each have a hermetic closure mechanism to prevent the vapors emanating from the refuse/waste from smelling up the interior.

The excavation of the trench or hole in the ground can be done by hand with a shovel. Alternatively, the tent structure may be received in a preplanned, below-surface concrete trench or foxhole. In the latter instance, it would be feasible to quickly excavate a buried concrete trench and the like using shaped explosives.

The invented temporary/portable fallout shelter has been described in context of schematic and representative embodiments. Many variations and modifications can be made to the invented shelter which, while not described herein, fall within the spirit and the scope of the invention as described in the appended claims.

I claim:

1. A portable shelter for placement over a hole in the ground comprising in combination, a tent enclosure having a floor with a tubular section extendable downwardly therefrom, means for supporting the tent enclosure to form an enclosed volume above the hole, the tubular section of the tub floor extending downwardly into and lining the hole, a shield membrane approximately dimensioned and having sufficient surface area to completely cover the tent enclosure when erected, with its circumferential edge extending into and partially buried in a shallow trench excavated around the tent enclosure and hole.

2. The portable shelter of claim 1, wherein the shield membrane has a circumferential edge formed by a tubular enclosure integral with the membrane.

3. The portable shelter of claim 2, wherein the tubular enclosure forming the circumferential edge of the shield membrane is hermetic to provide fluid storage.

4. The portable shelter of claim 3, further including means communicating with the tubular enclosure forming the circumferential edge of the fly membrane for introducing and draining fluids into and from the tubular enclosure.

5. The portable shelter of claim 1, wherein the tent enclosure including the tubular section extendable from the floor are formed by tightly woven, rip-resistant panels joined together.

6. The portable shelter of claim 5, wherein the shield membrane is a coated, rip-resistant plastic sheet material reflective of solar radiations.

7. The portable shelter of claim 5, wherein the interior surfaces of the fabric panels and junctions between each panel are coated with a sealing material for rendering the tent enclosure essentially airtight.

8. The portable fallout shelter of claim 7, wherein the tent enclosure is formed of at least two modular unit enclosures connected together, each unit enclosure including a separate hexahedral tubular section extending downward from its floor, further including:

means for allowing occupants to move between the hexahedral tubular sections of the respective unit enclosures, and means for hermetically isolating the respective hexahedral tubular sections from each other.

9. The portable fallout shelter of claim 5, further including pockets incorporated into the lining of the tubular section extending downwardly, the pockets opening into the tent enclosure, and means for hermetically sealing and isolating the pockets from the interior of the tent enclosure.

10. The portable fallout shelter of claim 9, wherein the pockets include vent tubes for allowing vapors emanating from wastes placed in the pockets to escape, and means located distant from the pocket for preventing gas flow through the tub into the pocket.

11. The portable fallout shelter of claim 1, further including walls and and a floor composed of concrete type materials forming a trench below the ground surface over which the tent enclosure is erected, the tubular section of the enclosure having a hexahedral configuration for lining the trench.

12. The portable fallout shelter of claim 11, wherein the trench has been filled with dirt, and including means for explosively excavating the dirt from the trench.

13. The shelter of claim 1, wherein the shield membrane is formed of at least two (2) modular membrane sheets, each sheet having means forming its circumferential edge for hermetic engagement with similar means, forming the circumferential edge of the remaining sheets.

14. A portable fallout shelter for use in combination with a hole in the ground comprising:

a tent enclosure formed of a hermetic flexible material, including:

a plurality of inflatable tubular rib sections, a circumferential edge formed into a tubular section for containing water extending from the exterior perimeter of the tent enclosure, a floor having sufficient slack to extend downwardly into the hole for lining the hole, the tent enclosure being erected by inflating the inflatable tubular sections with a gas, the enclosure being anechored by filling the tubular section forming the circumferential edge with water and partially burying the water-filled circumferential edge in a shallow trench excavated around the perimeter of the enclosure.

15. The portable fallout shelter of claim 14, further including an access port through a side wall of the enclosure and means for closing and hermetically sealing the access port from the interior of the enclosure.

16. The portable fallout shelter of claim 15 or 5, further including means for circulating and filtering air into and out of the enclosure.

* * * * *